US009375050B2

(12) United States Patent
Chiu

(10) Patent No.: US 9,375,050 B2
(45) Date of Patent: Jun. 28, 2016

(54) INSOLE WITH INDIVIDUAL ELASTIC COMPONENTS

(71) Applicant: ZEN YANGS INDUSTRIAL CO., LTD., Kaohsiung (TW)

(72) Inventor: Chih Chiu, Kaohsiung (TW)

(73) Assignee: ZEN YANGS INDUSTRIAL CO., LTD., Kaohsiung (TW)

( * ) Notice: Subject to any disclaimer, the term of this patent is extended or adjusted under 35 U.S.C. 154(b) by 762 days.

(21) Appl. No.: 13/633,126

(22) Filed: Oct. 1, 2012

(65) Prior Publication Data

US 2013/0219746 A1 Aug. 29, 2013

(30) Foreign Application Priority Data

Feb. 29, 2012 (TW) ..... 101203582 U

(51) Int. Cl.

*A43B 7/14* (2006.01)
*A43B 17/08* (2006.01)
*A43B 17/03* (2006.01)

(52) U.S. Cl.

CPC ..... *A43B 17/08* (2013.01); *A43B 7/142* (2013.01); *A43B 7/143* (2013.01); *A43B 7/144* (2013.01); *A43B 7/149* (2013.01); *A43B 7/1425* (2013.01); *A43B 7/1435* (2013.01); *A43B 7/1445* (2013.01); *A43B 17/03* (2013.01)

(58) Field of Classification Search

CPC ..... A43B 7/087; A43B 7/142; A43B 7/144; A43B 7/1445; A43B 7/146; A43B 17/08; A43B 17/18

USPC ..... 36/3 B, 43, 44, 145, 147

See application file for complete search history.

(56) References Cited

U.S. PATENT DOCUMENTS

| | | | | |
|---|---|---|---|---|
| 989,894 | A * | 4/1911 | Byrne | 36/153 |
| 2,146,888 | A * | 2/1939 | Fisch | A43B 17/08 36/3 B |
| 3,757,774 | A * | 9/1973 | Hatuno | 601/28 |
| 5,619,809 | A * | 4/1997 | Sessa | 36/3 R |
| 5,845,418 | A * | 12/1998 | Chi | 36/3 B |
| 5,896,680 | A * | 4/1999 | Kim et al. | 36/28 |
| 6,076,282 | A * | 6/2000 | Brue' | A43B 7/081 36/141 |
| 6,178,662 | B1 * | 1/2001 | Legatzke | 36/3 R |
| 7,703,219 | B2 * | 4/2010 | Beck | 36/44 |
| 7,712,229 | B2 * | 5/2010 | Yang | 36/3 B |
| 2004/0020081 | A1 * | 2/2004 | Symons et al. | 36/117.1 |
| 2008/0301979 | A1 * | 12/2008 | Lee | 36/3 B |
| 2010/0170117 | A1 * | 7/2010 | Kim | 36/3 B |
| 2011/0041365 | A1 * | 2/2011 | Ludemann | 36/3 R |

FOREIGN PATENT DOCUMENTS

TW M422883 2/2012

OTHER PUBLICATIONS

Zheng, Shi-Rong; Abstract of TW M422883; Feb. 21, 2012.

* cited by examiner

*Primary Examiner* — Khoa Huynh
*Assistant Examiner* — Sharon M Prange

(57) ABSTRACT

An insole with individual elastic components has an elastic pad with a ventilative layer adhered to the top surface and a supporting block disposed at the heel region on the bottom surface. The elastic pad has first hollow elastic pillars in the foot-thenar region and second hollow elastic pillars in the foot-arch region, with both pillars extending from the bottom surface and having openings toward the top surface. The elastic pad is formed as a single body. The height of the first hollow elastic pillars and the second hollow elastic pillars is greater than the height of the supporting block so that ventilation and cushioning effects are provided to improve air circulation inside the shoe when the insole is pressed.

7 Claims, 6 Drawing Sheets

INSOLE WITH INDIVIDUAL ELASTIC COMPONENTS

FIELD OF THE INVENTION

The present invention relates to a shoe component and more specifically to an insole with individual elastic components.

BACKGROUND OF THE INVENTION

Generally speaking, consumers will put elastic pads (insoles) inside shoes to increase resilience and comfort; however, conventional elastic pads are made of airproof materials so that even with ventilative layers disposed on top of the conventional elastic pads, odors will emanate from shoes due to poor air circulation and sweat.

According to Taiwan Utility model patent M422883, "A respiring elastic insole" is disclosed. The respiring elastic insole is placed inside a shoe comprising a top layer, a middle layer, and a bottom layer where the middle layer is formed by a plurality of long hollow tubes disposed between the top layer and the bottom layer. Even though both lateral openings of the tubes are located at the toe potion and at the heel potion of the insole, when the insole is pressed, the effect of ventilation will not affect the contact surface between the foot and the insole. Moreover, the deformation of the tubes is limited by the displacement of the elastic insole and is easy to crack. Only after a considerable displacement of the elastic insole will circulation inside a shoe caused by the elastic insole become effective.

SUMMARY OF THE INVENTION

AN objective of the present invention is to provide an insole with individual elastic components to generate ventilation and cushioning once the insole is pressed to improve air circulation inside a shoe and to automatically achieve replenishment of air when the insole is not pressed.

According to an embodiment of the present invention, an insole with individual elastic components is provided, primarily comprising a soft-elastic pad having a top surface and a bottom surface where a ventilative layer is adhered to the top surface. The bottom surface includes a foot-thenar region, a heel region, and a foot-arch region where a supporting block is disposed at the heel region. The soft-elastic pad is formed as a single body having a plurality of first hollow elastic pillars and a plurality of second hollow elastic pillars extended from the bottom surface with openings facing toward the top surface where the first hollow elastic pillars are located within the foot-thenar region and the second hollow elastic pillars are located within the foot-arch region and each of a first extruded height of the first hollow elastic pillars and a second extruded height of the second hollow elastic pillars is greater than a third extruded height of the supporting block.

From the above ventilated solution, an embodiment insole with individual elastic components provided in the present invention has the following advantages and virtues:

1. Through a specific design combination of the height difference and locations of the first hollow elastic pillars, the second hollow elastic pillars, and the supporting block as a technical means, when the insole is slightly pressed without deforming the supporting block at the heel region, the first hollow elastic pillars and the second hollow elastic pillars will be firstly squeezed and deformed to force the air inside the first hollow elastic pillars and the second hollow elastic pillars to spurt upwards and out from the openings. When the first hollow elastic pillars and the second hollow elastic pillars are not pressed, the first hollow elastic pillars and the second hollow elastic pillars will return to their original shapes where air inside a shoe will refill into the first hollow elastic pillars and the second hollow elastic pillars to cause the insole to function as an air cushion. Therefore, when the insole is pressed, ventilation and cushioning functions will become effective to improve air circulation inside a shoe.

DETAILED DESCRIPTION OF THE INVENTION

With reference to the attached drawings, the present invention is described by means of the embodiment(s) below where the attached drawings are simplified for illustration purposes only to illustrate the structures or methods of the present invention by describing the relationships between the components and assembly in the present invention. Therefore, the components shown in the figures are not expressed with the actual numbers, actual shapes, actual dimensions, nor with the actual ratios. Some of the dimensions or dimension ratios have been enlarged or simplified to provide a better illustration. The actual numbers, actual shapes, or actual dimension ratios can be selectively designed and disposed and the detail component layouts may be more complicated.

Figure 1:
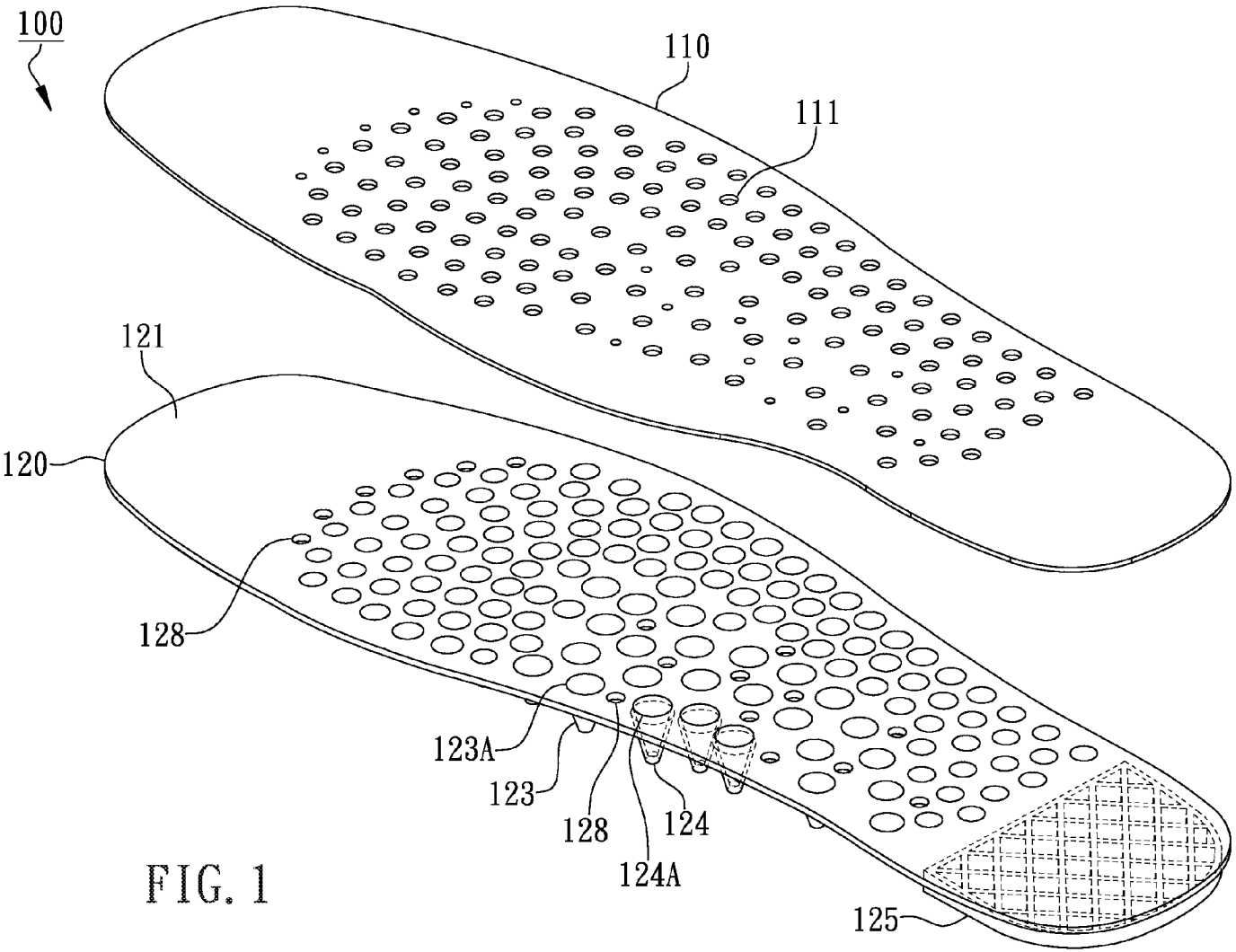
FIG. 1 is a three-dimensional component exploded view of an insole with individual elastic components according to the preferred embodiment of the present invention.
Figure 2:
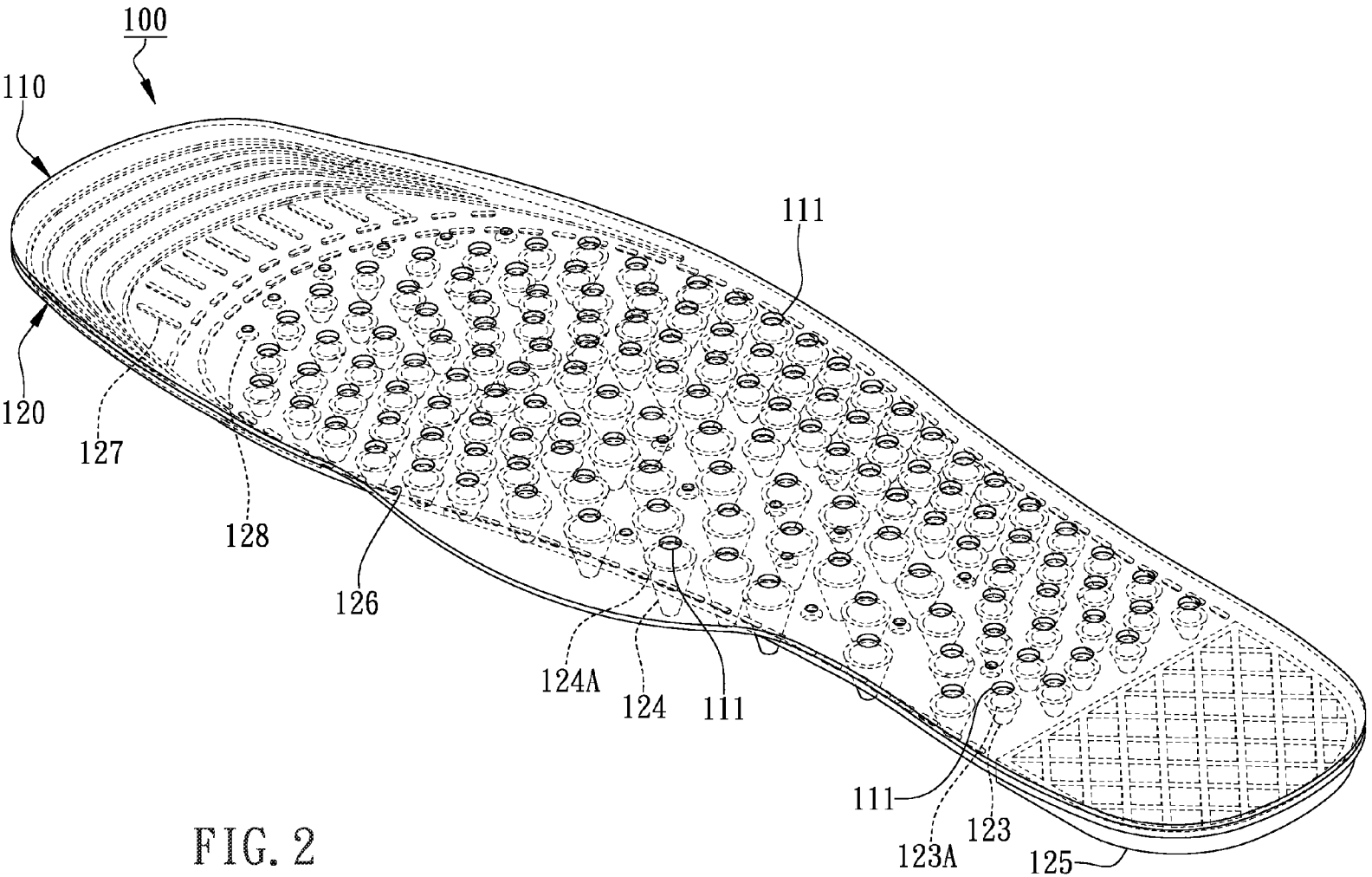
FIG. 2 is a three-dimensional view of the insole with individual elastic components according to the preferred embodiment of the present invention.
Figure 3:
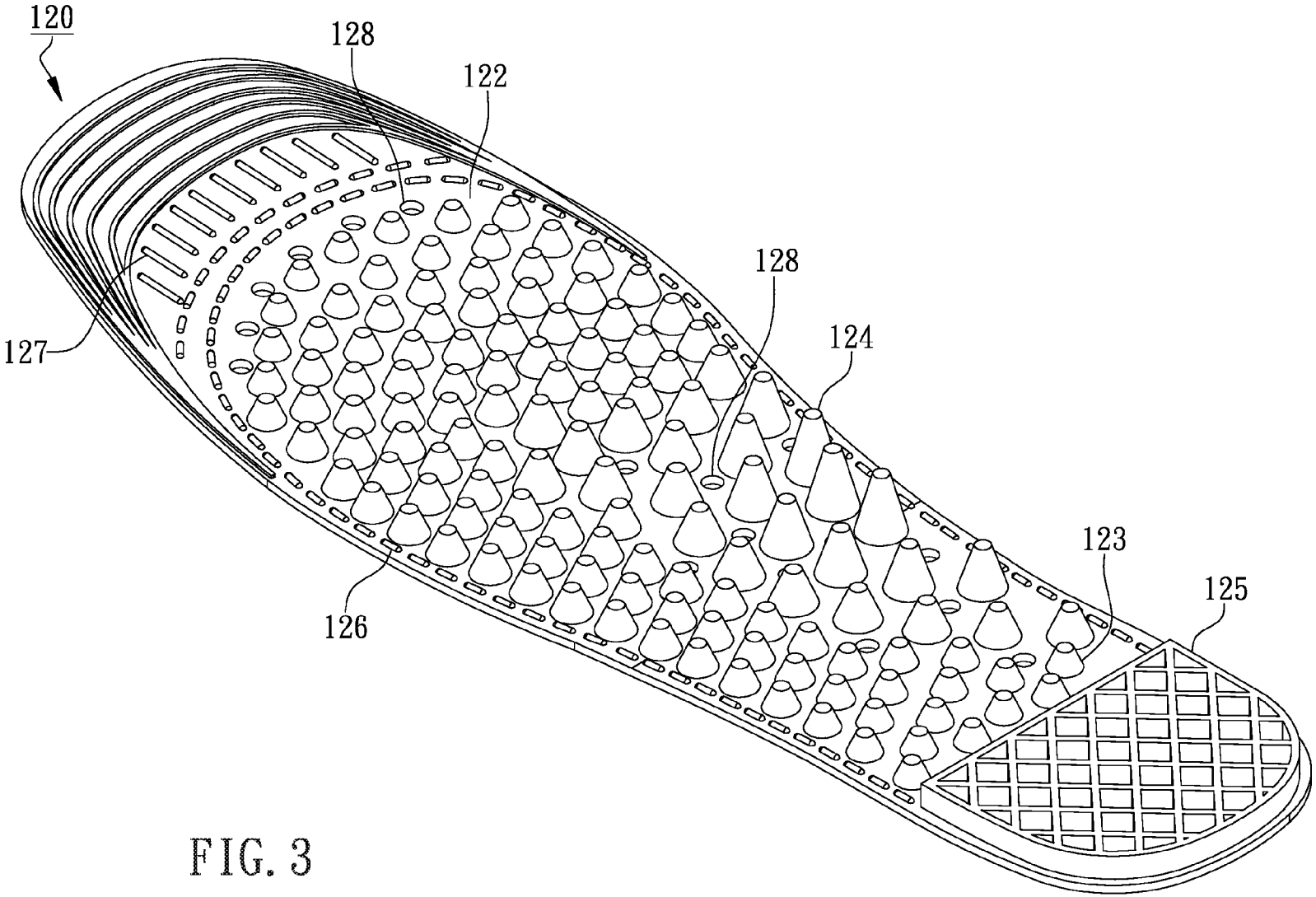
FIG. 3 is a three-dimensional view of the bottom surface of the soft-elastic pad of the insole according to the preferred embodiment of the present invention.
Figure 4:
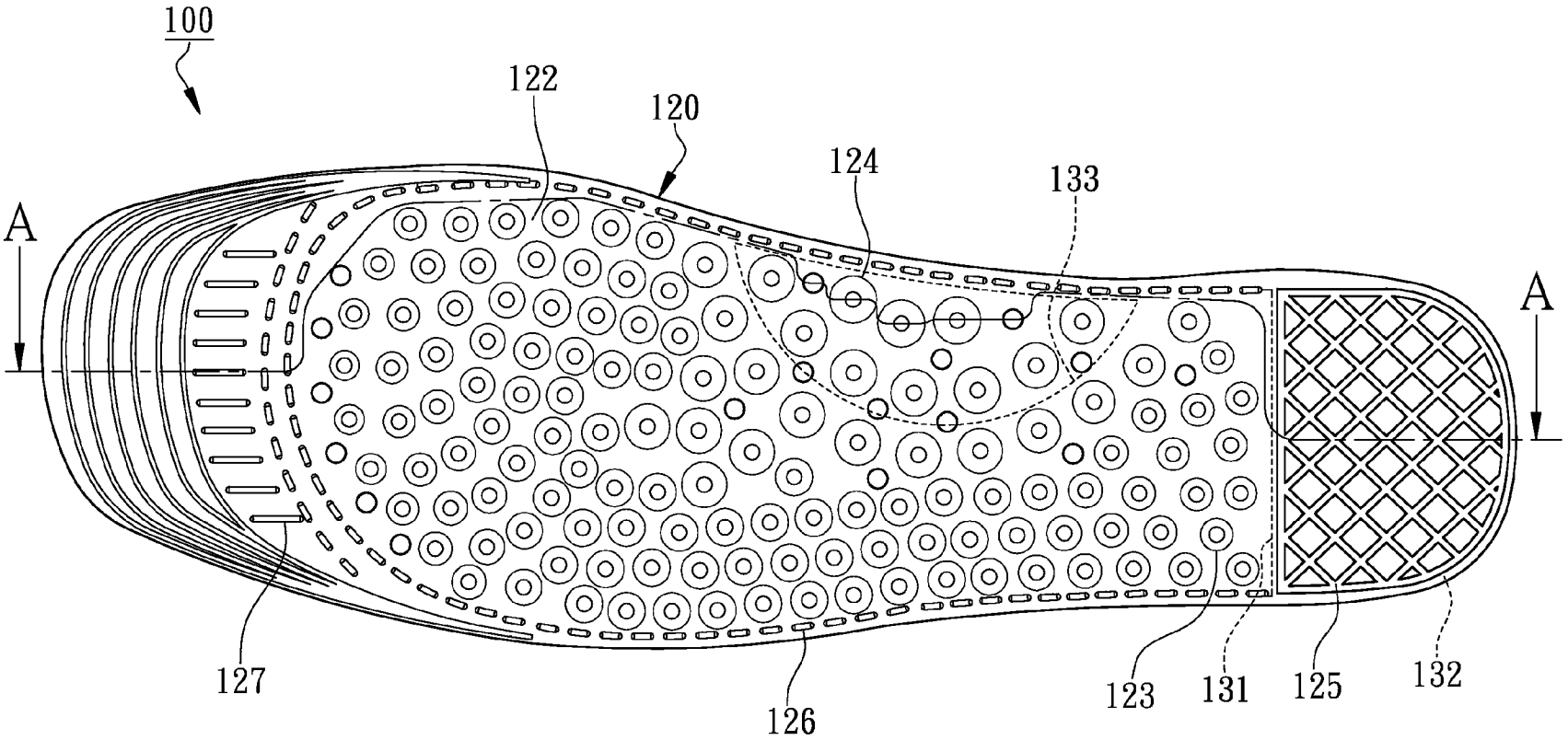
FIG. 4 is a bottom view of the insole showing the bottom surface of the soft-elastic pad according to the preferred embodiment of the present invention.
Figure 5:
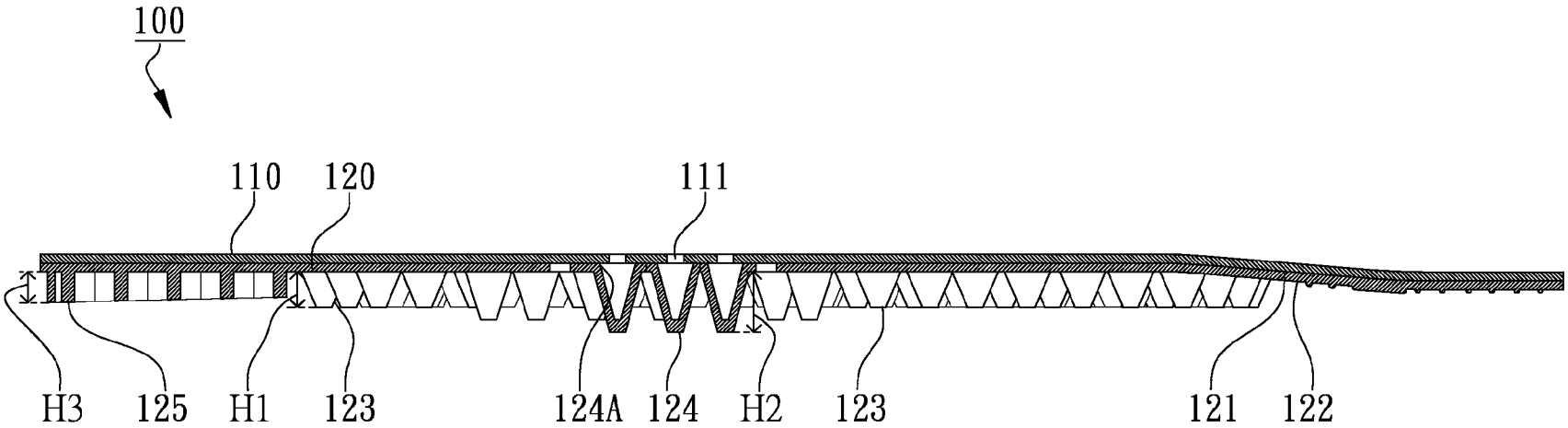
FIG. 5 is a cross-sectional view of the insole along the dashed line A-A of FIG. 4 according to the preferred embodiment of the present invention.

According to the preferred embodiment of the present invention, an insole with individual elastic components is shown in FIG. 1 with a component exploded view, and FIG. 2 shows a three-dimensional view. The insole 100 comprises a ventilative layer 110 and a soft-elastic pad 120, where FIG. 3 provides a three-dimensional view of the bottom surface of the soft-elastic pad 120, FIG. 4 is a bottom view of the insole 100 showing the bottom surface of the soft-elastic pad 120, and FIG. 5 is a cross-sectional view of the insole 100 along dashed line A-A shown in FIG. 4. As shown in FIG. 5, the soft-elastic pad 120 has a top surface 121 and a bottom surface 122 where a ventilative layer 110 is adhered to the top surface 121 of the soft-elastic pad 120. Normally, the ventilative layer 110 is made of leather, such as ventilative leather, sheepskin or a synthetic leather or ventilative cloth. The soft-elastic pad 120 can be made of silica gel or rubber to provide a soft and elastic feeling for the user through the associated material characteristics and is formed in one body with numerous elastic gasbags. When ventilative leather is chosen for the ventilative layer 110 to provide good ventilation, the ventilative layer 110 can be adhered to the soft-elastic pad 120 through adhesive or thermal compression to form a compact structure in one body.

As shown in FIG. 4, the bottom surface 122 includes a foot-thenar region 131, a heel region 132, and a foot-arch region 133, where the heel region 132 corresponds to the contact portion of the insole 100 to the heel portion of a human foot, the foot-arch region 133 corresponds to the contact portion of the insole 100 to the foot-arch portion of a human foot, where the foot-arch portion is the arc portion of a human foot, and the foot-thenar region 131 is the region between the toe region and the heel region excluding the foot-arch region 133. A supporting block 125 is disposed on the heel region 132 to support a human foot. Preferably, the supporting block 125 is elastic and formed in one body with the soft-elastic pad 120 for ease of manufacture and formation. As shown in FIG. 3 and FIG. 4, the supporting block 125 has a non-circular meshed groove to fully cover the heel region 132 to achieve better heel support.

As shown in FIG. 3, in the present embodiment, a plurality of first slip-proof strips 126 are disposed on the edge of the bottom surface 122 of the soft-elastic pad 120 to prevent the insole 100 from slipping inside a shoe. A plurality of second slip-proof strips 127 are disposed on the edges of the toe region on the bottom surface 122 of the soft-elastic pad 120 to prevent the insole 100 from slipping toward the toe of the shoe. In the present embodiment, the total area of the foot-thenar region 131 and the foot-arch region 133 can be defined and enclosed by the first slip-proof strips 126 and the supporting block 125. Furthermore, the orientations of the second slip-proof strips 127 can be different from the orientations of the adjacent first slip-proof strips 126 to provide slip-proof functions in different directions. To be more specific, the second slip-proof strips 127 are parallel to the corresponding toes of users to prevent the toe region from slipping right and left and the second slip-proof strips 127 may further include extended arc strips. The first slip-proof strips 126 are arranged in a dashed format so that each length of the first slip-proof strip 126 is not greater than each length of the second slip-proof strip 127.

As shown from FIG. 1 to FIG. 5, the soft-elastic pad 120 is formed in one body with a plurality of first hollow elastic pillars 123 and a plurality of second hollow elastic pillars 124 disposed on and extending from the bottom surface 122; each pillar has an opening facing toward the top surface 121 where the first hollow elastic pillars 123 are located in the foot-thenar region 131 and the second hollow elastic pillars 124 are located in the foot-arch region 133 as shown in FIG. 3. Moreover, as shown in FIG. 5, each of the first extruded height H1 of the first hollow elastic pillars 123 and the second extruded height H2 of the second hollow elastic pillars 124 is greater than a third extruded height H3 of the supporting block 125. The so-called "extruded height" means the vertical distance measured from the bottom surface 122 of the soft-elastic pad 120 to the tip of the component. The third extruded height H3 of the supporting block 125 is measured from the edge of the most adjacent first hollow elastic pillars 123. To be more specific, the second extruded height H2 of the second hollow elastic pillars 124 is greater than the first extruded height H1 of the first hollow elastic pillars 123. In the present embodiment, the first extruded height H1 of the first hollow elastic pillars 123 ranges from 6 mm to 8 mm, the second extruded height H2 of the second hollow elastic pillars 124 ranges from 8 mm to 11 mm and the third extruded height H3 of the supporting block 125 ranges from 5 mm to 8 mm Furthermore, preferably, as shown in FIG. 5, a supporting surface of the supporting block 125 is slightly inclined to the first hollow elastic pillars 123 so that when the first hollow elastic pillars 123 are pressed and deformed, the supporting surface of the supporting block 125 will be able to closely contact with the bottom of the shoe to increase the friction between the two.

Therefore, through a specific design combination of the height difference and locations of the first hollow elastic pillars 123, the second hollow elastic pillars 124, and the supporting block 125 as a technical mean of an embodiment of the present invention, when the insole 100 is slightly pressed without deforming the supporting block 125 at the heel region, the first hollow elastic pillars 123 and the second hollow elastic pillars 124 will be squeezed and deformed to force the air inside the first hollow elastic pillars 123 and the second hollow elastic pillars 124 to spurt upwards and out from their respective openings. When the first hollow elastic pillars 123 and the second hollow elastic pillars 124 are not pressed, the first hollow elastic pillars 123 and the second hollow elastic pillars 124 may return to their original shapes where air inside a shoe can refill into the first hollow elastic pillars 123 and the second hollow elastic pillars 124 to provide the insole 100 with an air cushioning function. Therefore, when the insole 100 is pressed, functions of ventilation and cushioning will become effective to improve air circulation inside a shoe.

Figure 6:
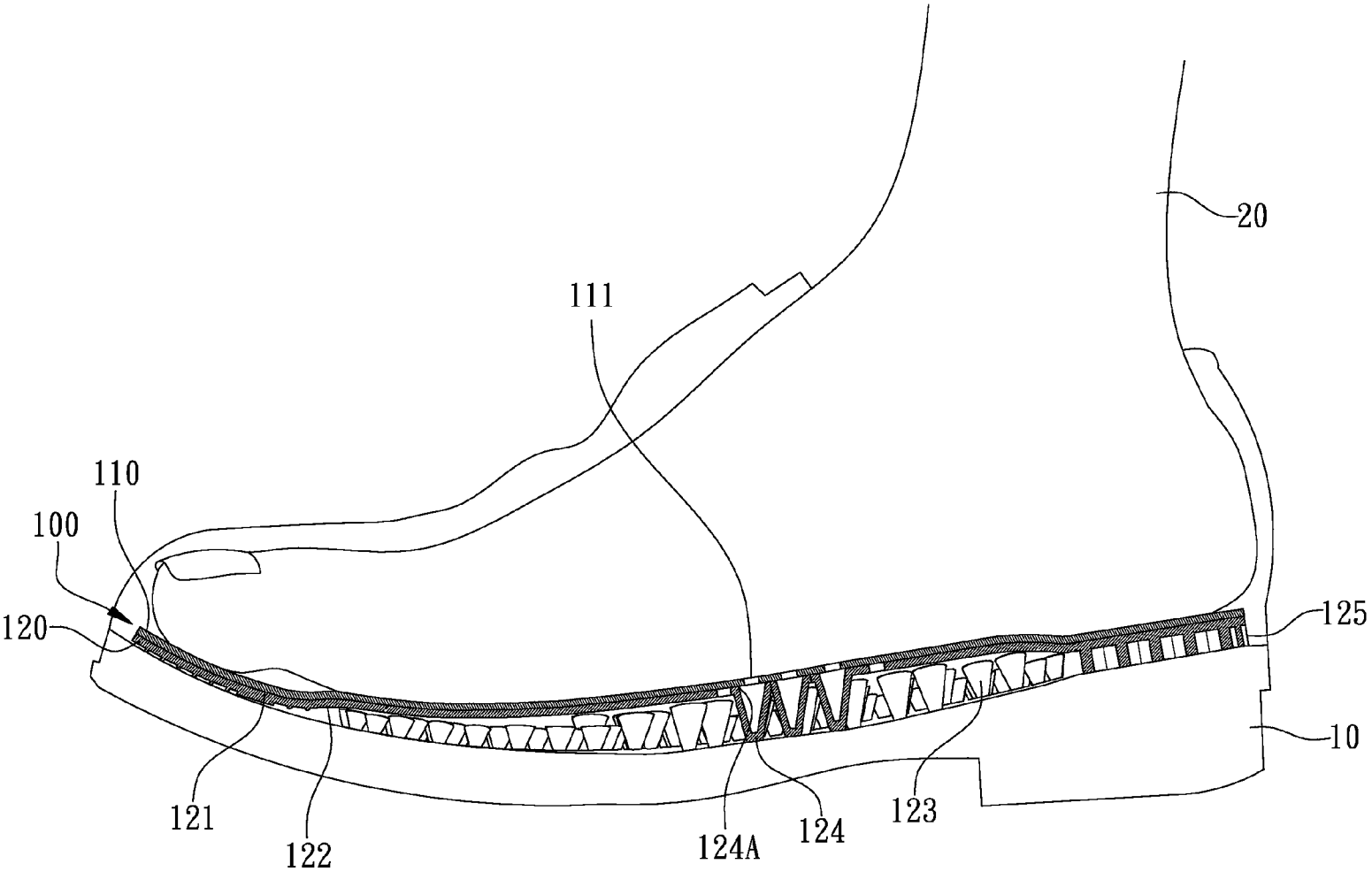
FIG. 6 is a perspective side view illustrating the insole with individual elastic components disposed inside a shoe when worn according to the preferred embodiment of the present invention.

Moreover, each first hollow elastic pillar 123 has a corresponding opening 123A and each second hollow elastic pillar 124 has a corresponding opening 124A facing toward the top surface 121 as shown in FIG. 1. Preferably, the shapes of the first hollow elastic pillars 123 and the second hollow elastic pillars 124 are cones having flat circular tips to enhance shape restoration of the first hollow elastic pillars 123 and the second hollow elastic pillars 124. Moreover, the ventilative layer 110 has a plurality of through holes 111 aligned with the openings 123A and 124A. Therefore, the first hollow elastic pillars 123 and the second hollow elastic pillars 124 become elastic structures with multiple airbags which will spurt air upwards and out from the openings. As shown in FIG. 6, the insole 100 is installed inside a shoe 10 and will be pressed when a user is walking so that the first hollow elastic pillars 123 and the second hollow elastic pillars 124 will be repeatedly deformed and jet air to the bottom of a human foot 20 or exert upward pressure as a counterforce to the bottom of the foot 20 to achieve air ventilation and cushioning for the bottom of the feet 20.

Preferably, the diameter of the through holes 111 can be smaller than the diameter of the opening 123A and 124A to maintain the strength of the ventilative layer 110 and the contact surface to human feet 20. Moreover, a plate portion of the soft-elastic pad 120 has a plurality of ventilating holes 128 penetrating through the soft-elastic pad 120, exposed from the ventilative layer 110 and not aligned with the openings 123A and 124A to shorten the air flowing distance of the air outside the insole 100 from the first hollow elastic pillars 123 and the second hollow elastic pillars 124 to improve air circulation inside a shoe.

The above description of embodiments of this invention is intended to be illustrative but not limiting. Other embodiments of this invention will be obvious to those skilled in the art in view of the above disclosure which still will be covered by and within the scope of the present invention even with any modifications, equivalent variations, and adaptations.

What is claimed is:

1. An insole with individual elastic components comprising:

an elastic pad having a top surface and a bottom surface, and a ventilative layer adhered to the top surface, wherein the bottom surface includes a foot-thenar region, a heel region, and a foot-arch region, the heel region fully covered by a D-shaped elastic supporting block integrally formed with the elastic pad, the elastic pad further comprises a plurality of first hollow elastic pillars and a plurality of second hollow elastic pillars protruding from the bottom surface with respective openings facing toward the top surface, no openings formed in tips of the first and second hollow elastic pillars, the first hollow elastic pillars located within the foot-thenar region and the second hollow elastic pillars located within the foot-arch region, each of a first height of the first hollow elastic pillars and a second height of the second hollow elastic pillars being greater than a third height of the supporting block, the second height of the second hollow elastic pillars being greater than the first height of the first hollow elastic pillars, a plate portion of the elastic pad having a plurality of ventilating holes penetrating through the elastic pad without aligning with the openings of the first and second hollow elastic pillars; and wherein the ventilative layer has a plurality of through holes aligned with the openings of the first hollow elastic pillars and the openings of the second hollow elastic pillars facing toward the top surface.

2. The insole as claimed in claim 1, wherein the supporting block has a non-circular meshed groove.

3. The insole as claimed in claim 1, wherein a supporting surface of the supporting block inclines toward the first hollow elastic pillars.

4. The insole as claimed in claim 1, wherein a diameter of the through holes are smaller than a diameter of the openings.

5. The insole as claimed in claim 1, wherein a plurality of first slip-proof strips are disposed on edges of the bottom surface of the elastic pad.

6. The insole as claimed in claim 5, wherein a plurality of second slip-proof strips are disposed on a side of the bottom surface of the elastic pad facing toward a toe region of the elastic pad.

7. The insole as claimed in claim 1, wherein the first hollow elastic pillars and the second hollow elastic pillars are cones having flat circular tips.

* * * * *